US006740404B1

(12) United States Patent
Cziollek et al.

(10) Patent No.: US 6,740,404 B1
(45) Date of Patent: May 25, 2004

(54) HMLS-FIBERS MADE OF POLYESTER AND A SPIN-STRETCH PROCESS FOR ITS PRODUCTION

(75) Inventors: Joachim Cziollek, Mainz (DE); Werner Mrose, Maintal (DE); Dietmar Wandel, Hanau (DE); Helmut Schwind, Hanau (DE); Wolfgang Janas, Geiselbach (DE); Werner Ude, Darmstadt (DE)

(73) Assignee: Zimmer AG, Frankfurt am Main (DE)

( * ) Notice: Subject to any disclaimer, the term of this patent is extended or adjusted under 35 U.S.C. 154(b) by 168 days.

(21) Appl. No.: 10/049,009

(22) PCT Filed: Jul. 25, 2000

(86) PCT No.: PCT/EP00/07085

§ 371 (c)(1),
(2), (4) Date: Jun. 6, 2002

(87) PCT Pub. No.: WO01/11122

PCT Pub. Date: Feb. 15, 2001

(30) Foreign Application Priority Data

Aug. 10, 1999 (DE) ..... 199 37 728

(51) Int. Cl.[7] ..... D02G 3/00; B32B 27/34; B32B 27/36; B28B 3/20; B29C 47/00

(52) U.S. Cl. ..... 428/372; 264/176.1; 264/177.13; 264/210.8; 428/364; 428/395

(58) Field of Search ..... 428/364, 372, 428/395; 264/176.1, 177.13, 210.8

(56) References Cited

U.S. PATENT DOCUMENTS

| | | | | |
|---|---|---|---|---|
| 5,092,381 A | | 3/1992 | Feijen et al. | 152/451 |
| 5,403,659 A | | 4/1995 | Nelson et al. | 428/364 |
| 5,565,522 A | | 10/1996 | Bohringer et al. | 525/176 |
| 5,962,131 A | | 10/1999 | Schwind et al. | 428/364 |
| 6,656,583 B1 | * | 12/2003 | Cziollek et al. | 428/372 |

FOREIGN PATENT DOCUMENTS

| | | |
|---|---|---|
| EP | 0 201 114 A | 11/1986 |
| EP | 0 631 638 B | 2/1996 |
| WO | WO 90 00638 A | 1/1990 |
| WO | WO 99 07927 A | 2/1999 |

* cited by examiner

*Primary Examiner*—Patrick D. Niland
(74) *Attorney, Agent, or Firm*—Norris McLaughlin & Marcus P.A.

(57) ABSTRACT

HMLS filaments consisting of a polyester, from 0.1 to 2.5% by weight of an incompatible, thermoplastic, amorphous, polymeric additive having a glass transition temperature of from 90 to 170° C. and a ratio of its melt viscosity to that of the polyester component of from 1:1 to 7:1, and from 0 to 5.0% by weight of conventional additives, where the polymeric additive is present in the filaments in the form of fibrils having a mean diameter of ≦80 nm.

Process for the production of these HMLS filaments by static mixing with shearing of the polyester and of the polymeric additive and, optionally, of the additives, spinning of the mixture at a spinning take-off speed of from 2500 to 4000 m/min to give spun filaments which are stretched, heat-set and wound up, where the concentration of the polymeric additive is determined as a function of the prespecified spinning take-off speed and the desired birefringence of the spun filaments.

14 Claims, No Drawings

HMLS-FIBERS MADE OF POLYESTER AND A SPIN-STRETCH PROCESS FOR ITS PRODUCTION

The invention relates to HMLS polyester filaments having a tear strength of >70 cN/tex, an LASE 5 of >35 cN/tex and a hot-air shrinkage at 160° C. of 1.5–3.5%, and to a spin-stretch process for the production of the HMLS filaments. The term HMLS filaments here is taken to mean stretched polyester multifilaments of high modulus and low shrinkage.

Polyethylene terephthalate multifilaments of high LASE 5 (the specific force which corresponds to an elongation of 5% in the stress-strain diagram) and low thermal shrinkage are known, as are processes for their production, the yarns being employed for industrial applications, such as tyre cord. Processes of this type are described, inter alia, in the patent specifications U.S. Pat. No. 5,067,538. EP 0 423 213 B, U.S. Pat. Nos. 4,101,525 and 5,472,781. It is clear in these publications that the stretching ratio that can be used drops, the steepness of the stress-strain diagram. i.e. the LASE 5, increases, the thermal shrinkage drops and the achievable strength drops with increasing spinning take-off speed. The drop in the usable stretching ratio is due to the increase in the orientation in the spun filament and is characterized by an increase in the birefringence of the spun filament.

U.S. Pat. No. 4,491,657 only achieves tear strengths of 62 cN/tex in the subsequent stretching process at a spinning speed of 3000 m/min. In EP 0 423 213 B. Tables 2 and 5 show that at the stretching ratios that can be used in practice, a tear strength of 69 cN/tex is already achieved at spinning speeds of 2900 m/min.

The drop in the usable stretching ratio with increasing spinning speed is exacerbated by higher spinning viscosities, as shown by U.S. Pat. No. 5,067,538. In this, the usable stretching ratio at an intrinsic viscosity of the polymer of 0.88 dl/g is already so low that end speeds of greater than 6000 m/min are no longer possible. EP 0 169 415 A describes a polyester spun filament having an intrinsic viscosity of greater than 0.9 dl/g. The stretching ratios that can be used for the various spinning speeds are so low that efficient end speeds of greater than 6000 m/min in spin-stretching are only possible at very high spinning take-off speeds of greater than 3500 m/min. In EP 0 546 859 A, a polyester filament is produced at spinning take-off speeds of from 2500 to 4000 m/min. Here too, the low stretchability, even at spinning take-off speeds of 4000 m/min, during high-speed spin-stretching give end speeds of just 6000 m/min, with the tear strength being lower than 65 cN/tex.

In addition, EP 0 438 421 B1 makes it clear that high-speed spin-stretching to give filaments results in a large number of capillary breaks. For this reason, a device which determines the stretching point is introduced there, reducing the capillary breakage level of HMLS filaments of this type to 20 defects/10 km in the best case.

Stretched yarns having tear strengths of greater than 70 cN/tex and low thermal shrinkage, produced at spinning speeds of greater than 2500 m/min, are also described in EP 0 526 740 B. These yarns consist of a polyester raw material based on a polyethylene terephthalate modified by copolymerization. These modifying components are incorporated into the polymer chain during the polymer formation process, which impairs the flexibility of the spinning operation.

It is furthermore known from WO 99/07927 A1 that the elongation at break of polyester pre-oriented yarn (POY) which has been spun at take-off speeds of at least 2500 m/min can be increased by the addition of amorphous, thermoplastic copolymers based on styrene, acrylic acid and/or maleic acid or derivatives thereof compared with the elongation at break of polyester filaments spun under identical conditions without addition. No data are given on the production of HMLS filaments by the spin-stretch process.

EP 0 047 464 B relates to an unstretched polyester yarn where improved productivity is obtained at speeds of between 2500 and 8000 m/min by increasing the elongation at break of the spun filament by addition of 0.2–10% by weight of a polymer of the —(—$CH_2$—$CR_1R_2$—)—n type, such as poly(4-methyl-1-pentene) or polymethyl methacrylate. Fine and uniform dispersion of the additive polymer by mixing is necessary, where the particle diameter must be $\leqq 1$ $\mu$m in order to avoid fibril formation. Besides the chemical structure of the additive, which hardly allows any elongation of the additive molecules, the crucial factor for the effect is said to be the low mobility and the compatibility of polyester and additive.

EP 0 631 638 B describes fibres predominantly comprising PET which comprises 0.1–5% by weight of a polyalkyl methacrylate which has been imidated to the extent of 50–90%. The fibres obtained at speeds of 500–10,000 m/min and subsequently subjected to final stretching are said to have a relatively high initial modulus. In the examples of industrial yarns, however, the effect on the modulus is not readily evident; in general, the strengths achieved are low, which is a considerable disadvantage of this product.

It is an object of the present invention to provide HMLS filaments having a tear strength of >70 cN/tex, an LASE 5 of >35 cN/tex and a hot-air shrinkage at 160° C. of from 1.5 to 3.5%, and to provide a spin-stretch process for the production thereof in which end speeds of greater than 6000 m/min can be achieved, even in the case of ultrahigh-viscosity polyester, with minimization of the number of capillary breaks. It should be possible to produce the desired HMLS filaments at high spinning speeds without the need for chemical modification of the polyester raw material, which would reduce the flexibility of the spinning machine. In addition, it should be possible to produce the HMLS filaments in a customized manner for the particular application by adjustment of the birefringence in the spun filament substantially independently of the spinning take-off speed. It should be possible to set birefringence values here in the range from $30 \cdot 10^{-3}$ to $55 \cdot 10^{-3}$.

The object on which the invention is based is achieved by HMLS polyester filaments and a spin-stretch process for their production as defined in the patent claims.

The term polyester here is taken to mean poly($C_{2-4}$-alkylene) terephthalates, which may comprise up to 15 mol % of other dicarboxylic acids and/or diols, such as, for example, isophthalic acid, adipic acid, diethylene glycol, polyethylene glycol. 1,4-cyclohexane-dimethanol, or the respective other $C_{2-4}$-alkylene glycols. Preference is given to polyethylene terephthalate having an intrinsic viscosity (I.V.) in the range from 0.8 to 1.4 dl/g, polypropylene terephthalate having an I.V. of from 0.9 to 1.6 dl/g and polybutylene terephthalate having an I.V. of from 0.9 to 1.8 dl/g. Conventional additives, such as dyes, matting agents, stabilizers, antistatics, lubricants and branching agents, may be added to the polyester or polyester/additive mixture in amounts of from 0 to 5.0% by weight without any disadvantage.

In accordance with the invention, the polyester is treated in the melt with an amorphous, thermoplastic, incompatible, polymeric additive which has a glass transition temperature of from 90 to 170° C., where the ratio of the melt viscosity of the additive to the melt viscosity of the polyester is from 1:1 to 7:1, the mixture is treated in a static mixer with shearing, with the shear rate being from 16 to 128 $s^{-1}$, and the product of the shear rate and the residence time in seconds to the power 0.8 is set to a value of at least 250, and the mixture is subsequently spun at a, spinning take-off speed v of from 2500 to 4000 m/min, stretched, thermally treated and wound up at ≧6000 m/min.

The additive polymers to be added to the polyester may have a different chemical composition so long as they have the above-mentioned physical properties. Three different types of polymer are preferred, namely 1. A polymer which comprises the following monomer units:

A=acrylic acid, methacrylic acid or $CH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-aryl radical, B=styrene or $C_{1-3}$-alkyl-substituted styrenes.

where the polymer consists of from 60 to 100% by weight of A and from 0 to 40% by weight of B, preferably of from 83 to 98% by weight of A and from 2 to 17% by weight of B, and particularly preferably of from 90 to 98% by weight of A and from 2 to 10% by weight of B (sum=100% by weight).

2. A polymer which comprises the following monomer units:

C=styrene or $C_{1-3}$-alkyl-substituted styrenes,

D=one or more monomers of the formula I, II or III (I)

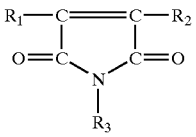

(II)

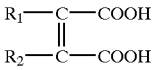

(III)

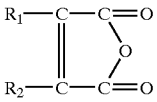

where $R_1$, $R_2$ and $R_3$ are each an H atom or a $C_{1-15}$-alkyl radical or a $C_{5-12}$-cycloalkyl radical or a $C_{6-14}$-aryl radical.

where the polymer consists of from 15 to 100% by weight of C and from 0 to 85% by weight of D, preferably of from 50 to 95% by weight of C and from 5 to 50% by weight of D, and particularly preferably of from 70 to 85% by weight of C and from 15 to 30% by weight of D, where the sum of C and D together gives 100%.

3. A polymer which comprises the following monomer units:

E=acrylic acid, methacrylic acid or $CH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-aryl radical, F=styrene or $C_{1-3}$-alkyl-substituted styrenes, G=one or more monomers of the formula I, II or III (I)

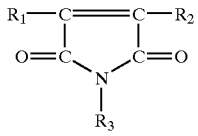

(II)

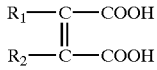

(III)

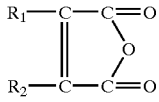

where $R_1$, $R_2$ and $R_3$ are each an H atom or a $C_{1-15}$-alkyl radical or a $C_{5-12}$-cycloalkyl radical or a $C_{6-14}$-aryl radical, H=one or more ethylenically unsaturated monomers which can be copolymerized with E and/or with F and/or G, from the group consisting of α-methylstyrene, vinyl acetate, acrylates and methacrylates which are different from E, vinyl chloride, vinylidene chloride, halogen-substituted styrenes, vinyl esters, isopropenyl ethers and dienes, where the polymer consists of from 30 to 99% by weight of E, from 0 to 50% by weight of F, from >0 to 50% by weight of G and from 0 to 50% by weight of H, preferably of from 45 to 97% by weight of E, from 0 to 30% by weight of F, from 3 to 40% by weight of G and from 0 to 30% by weight of H, and particularly preferably of from 60 to 94% by weight of E, from 0 to 20% by weight of F, from 6 to 30% by weight of G and from 0 to 20% by weight of H, where the sum of E, F, G and H together gives 100%.

Component H is an optional component. Although the advantages to be achieved in accordance with the invention can be achieved merely by means of polymers which have components from groups E to G, the advantages to be achieved in accordance with the invention also arise if further monomers from group H are involved in the build-up of the polymer to be employed in accordance with the invention.

Component H is preferably selected in such a way that it does not have an adverse effect on the properties of the polymer to be used in accordance with the invention. Component H can therefore be employed, inter alia, in order to modify the properties of the polymer in the desired manner, for example by increasing or improving the flow properties when the polymer is heated to the melting point, or for reducing a residual colour in the polymer or through the use of a polyfunctional monomer in order in this way to introduce a certain degree of crosslinking into the polymer. In addition, H may also be selected in such a way that copolymerisation of components E to G only becomes possible at all or is supported, as in the case of MSA and MMA, which do not copolymerise per se, but copolymerise without difficulty on addition of a third component, such as styrene.

The monomers which are suitable for this purpose include, inter alia, vinyl esters, esters of acrylic acid, for example methyl and ethyl acrylate, esters of methacrylic acid other than methyl methacrylate, for example butyl methacrylate and ethylhexyl methacrylate, vinyl chloride, vinylidene chloride, styrene, α-methylstyrene and the various halogen-substituted styrenes, vinyl and isopropenyl ethers, and dienes, such as, for example, 1.3-butadiene and divinylbenzene. The reduction in colour of the polymer can, for example, particularly preferably be achieved by use of an electron-rich monomer, such as, for example, a vinyl ether, vinyl acetate, styrene or α-methylstyrene. Of the compounds of component H, particular preference is given to aromatic vinyl monomers, such as, for example, styrene or α-methylstyrene.

The preparation of the polymers to be used in accordance with the invention is known per se. They can be prepared by mass, solution, suspension or emulsion polymerisation. Helpful information on mass polymerisation is given in Houben-Weyl, Volume E20, Part 2 (1987), pages 1145 ff. Information on solution polymerisation is likewise given therein on pages 1149 ff, while emulsion polymerisation is likewise mentioned and explained therein on pages 1150 ff.

For the purposes of the invention, particular preference is given to bead polymers whose particle size is in a particularly favourable range. The polymers to be used in accordance with the invention by, for example, mixing into the melt of the fibre polymers are preferably in the form of particles having a mean diameter of from 0.1 to 1.0 mm. However, larger or smaller beads or granules can also be employed, although smaller beads make particular demands on logistics, such as conveying and drying.

The imidated polymer types 2 and 3 can be prepared either from the monomers using a monomeric imide or by subsequent complete or preferably partial imidation of a polymer containing the corresponding maleic acid derivative. These additive polymers are obtained, for example, by complete or preferably partial reaction of the corresponding polymer in the melt phase with ammonia or a primary alkylamine or arylamine, for example aniline (Encyclopedia of Polymer Science and Engineering, Vol. 16 [1989], Wiley-Verlag, page 78). All the polymers according to the invention and, if indicated, their non-imidated starting polymers are commercially available or can be prepared by a process which is familiar to the person skilled in the art.

The concentration c of the polymeric additive in % by weight in the polyester is determined here as a function of the pre-specified take-off speed v in m/min and the desired birefringence of the spun filament An in accordance with the following formulae:

$$xf_1 \leqq c \leqq xf_2 \tag{1}$$

where $$f_1 = \frac{100 \cdot (\Delta n_o - \Delta n)}{\Delta n_o(7.2589 \cdot 10^{-6} \cdot v^2 - 7.7932 \cdot 10^{-2} \cdot v + 236.0755)} \tag{2}$$

$$f_2 = \frac{100 \cdot (\Delta n_o - \Delta n)}{\Delta n_o(5.9391 \cdot 10^{-6} \cdot v^2 - 6.3763 \cdot 10^{-2} \cdot v + 193.1527)} \tag{3}$$

Δn=birefringence of the polyester spun filament according to the invention with additive, $\Delta n_o$=birefringence of polyester spun filaments produced under identical spinning conditions, as in accordance with the invention, without additive, $\Delta n < \Delta n_o$ x=1 for additive polymers of type 1 or 3, and x=2.8 for additive polymers of type 2 (without acrylic compound).

The additive polymer is incompatible with the polyester, i.e. the additive is substantially insoluble in the polyester matrix, with the polyester and the additive polymer forming two phases which can be differentiated microscopically. Furthermore, the copolymer must have a glass transition temperature (determined by DSC with a heating rate of 10° C./min) of from 90 to 170° C. and must be thermoplastic.

The melt viscosity of the copolymer should be selected here so that the ratio of its melt viscosity extrapolated to the measurement time zero, measured at an oscillation rate of 2.4 Hz and a temperature which is equal to the melting point of the polyester plus 34.0° C. (290° C. for polyethylene terephthalate) relative to that of the polyester, measured under the same conditions, is between 1:1 and 7:1. i.e. the melt viscosity of the polymer is at least equal to or preferably greater than that of the polyester. The optimum effectiveness is only achieved through the choice of a specific viscosity ratio of additive to polyester. At a viscosity ratio optimised in this way, it is possible to minimize the amount of additive added, making the economic efficiency of the process particularly high. Surprisingly, the viscosity ratio determined as ideal in accordance with the invention for the use of polymer mixtures for the production of HMLS filaments is above the range indicated as favourable in the literature for the mixing of two polymers. In contrast to the prior art, polymer mixtures with high-molecular-weight additive polymers were highly suitable for spinning.

Due to the high flow activation energy of the additive polymers, the viscosity ratio after exit of the polymer mixture from the spinneret increases dramatically in the filament formation zone. The flow activation energy (E) here is a measure of the rate of change of the zero viscosity as a function of the change in measurement temperature, where the zero viscosity is the viscosity extrapolated to the shear rate 0 (M. Pahl et al., Praktische Rheologie der Kunststoffe und Elastomere [Practical Rheology of Plastics and Elastomers], VDI-Verlag, Düsseldorf (1995), pages 256 ff.). Through the choice of a favourable viscosity ratio, a particularly narrow particle size distribution of the additive in the polyester matrix is achieved, and by combining the viscosity ratio with a flow activation energy which is significantly greater than that of the polyester (PET about 60 kJ/mol), i.e. greater than 80 kJ/mol, a fibril structure of the additive is obtained in the spun filament. The high glass transition temperature compared with the polyester ensures rapid solidification of this fibril structure in the spun filament. The maximum particle sizes of the additive polymer here immediately after exiting from the spinneret are about 1000 nm, while the mean particle size is 400 nm or less. After drawing beneath the spinneret and after stretching, fibrils having a mean diameter of ≦80 nm are formed.

The ratio between the melt viscosity of the copolymer and that of the polyester under the above-mentioned conditions is preferably between 1.5:1 and 5:1. Under these conditions, the mean particle size of the additive polymer immediately after exiting from the spinneret is 120–300 nm, and fibrils having a mean diameter of about 40 nm are formed.

The mixing of the additive polymer with the matrix polymer is carried out by addition in the form of a solid to the matrix polymer chips in the extruder feed with chip mixer or gravimetric metering or alternatively by melting the additive polymer, metering by means of a gear pump and feeding into the melt stream of the matrix polymer. So-called masterbatch methods are also possible, where the additive is in the form of a concentrate in polyester chips, which are later added in the solid or molten state to the matrix polyester. Addition to a part-stream of the matrix polymer, which is then admixed with the main stream of the matrix polymer, is also practicable.

A homogeneous distribution is subsequently produced by mixing by means of static mixers. A defined particle distribution is advantageously established through a specific choice of the mixer and the duration of the mixing process before the melt mixture is fed on through product distribution lines to the individual spinning positions and spinnerets. Mixers having a shear rate of from 16 to 128 $sec^{-1}$ have proven successful. The product of the shear rate ($s^{-1}$) and the residence time (in sec) to the power 0.8 here should be at least 250. preferably from 350 to 1250. Values above 2500 are generally avoided in order to limit the pressure drop in the pipelines.

The shear rate here is defined by the empty pipe shear rate ($s^{-1}$) times the mixer factor, where the mixer factor is a characteristic parameter of the mixer type. For Sulzer SMX models, for example, this factor is about 7–8. The shear rate $\gamma$ in the empty pipe is calculated from $$\gamma = \frac{4 \cdot 10^3 \cdot F}{\pi \cdot \delta \cdot R^3 \cdot 60} [s^{-1}]$$

and the residence time t (s) is calculated from $$t = \frac{V_2 \cdot \varepsilon \cdot \delta \cdot 60}{F}$$

where

F=polymer transport rate (g/min)

$V_2$=internal volume of the empty pipe ($cm^3$)

R=empty pipe radius (mm)

$\epsilon$=empty volume proportion (from 0.84 to 0.88 in the case of Sulzer SMX models)

$\delta$=nominal density of the polymer mixture in the melt (about 1.2 $g/cm^3$).

Both the mixing of the two polymers and the subsequent spinning of the polymer mixture are carried out at temperatures, depending on the matrix polymer, in the range from 220 to 320° C. preferably at (melting point of the matrix polymer+34)+25/−20° C. For PET, temperatures of from 270 to 315° C. are preferably set.

The production of the HMLS filaments from the polymer mixtures according to the invention by spinning at take-off speeds of from 2500 to 4000 m/min, stretching, heat setting and winding are carried out using spinning apparatuses known per se in the same way as for polyester without additive. The filter pack here is fitted with filter devices and/or loose filter media in accordance with the known prior art.

After shear and filtration treatment in the spinneret pack, the molten polymer mixture is pressed through the holes of the spinneret plate. In the subsequent cooling zone, the melt filaments are cooled to below their solidification point by means of cooling air, so preventing sticking or bunching at the subsequent filament guide element. The cooling air can be supplied from an air-conditioning system by transverse or radial blowing. After cooling, the spun filaments are treated with spin finish, taken off at a defined speed via godet roll systems, subsequently stretched, heat-set and finally wound up. Filament intermingling devices can advantageously be included in the process.

It is typical of HMLS polyester filaments that they are produced in large direct melt spinning machines in which the melt is distributed over the individual spinning lines and over the individual spinning systems within the lines via long heated product lines. A spinning line here is a lining up of at least one row of spinning systems, and a spinning system represents the smallest spinning unit with a spinning head which contains at least one spinneret pack including spinneret plates. The melt in such systems is subjected to a high thermal load at residence times of up to 35 minutes. As a consequence of the high thermal stability of the additive, the effectiveness of the polymer additive according to the invention does not result in any significant restriction of its action, and consequently a small added amount of the additive of ≦2.5% and in many cases ≦1.5% is sufficient in spite of a high thermal load.

The properties of the additive polymer and the mixing technique have the effect that the additive polymer forms spheroidal or elongated particles in the matrix polymer immediately after exit of the polymer mixture from the spinneret. The best conditions arose when the mean particle size (arithmetic mean) $d_{50}$ was ≦400 nm, and the proportion of particles >1000 nm in a sample cross section was less than 1%.

The effect of the spinning draft or stretching on these particles has been determined analytically. Recent investigations of the filaments by the TEM (transmission electron microscopy) method have shown that a fibril-like structure exists therein. The mean diameter of the fibrils was estimated at about 40 nm, and the length/diameter ratio of the fibrils at >50. These fibrils cause a "microroughness" of the fibre surface, which results in better cord/rubber adhesion and is highly prized on use of the yarn, for example, as tyre cord. If these fibrils are not formed or if the additive particles after exiting from the spinneret are too large in diameter or if the size distribution is not uniform enough, which is the case at an inadequate viscosity ratio, the effect is lost.

Furthermore, a glass transition temperature of from 90 to 170° C. and preferably a flow activation energy of the additive polymers of at least 80 kJ/mol, i.e. a higher flow activation energy than that of the polyester matrix, is necessary for the effectiveness of the additives in accordance with this invention. Under this prerequisite, it is possible for the additive fibrils to solidify before the polyester matrix and to absorb a considerable proportion of the spinning stress present. The additives preferably to be used are, in addition, distinguished by high thermal stability. Thus, the loss of effectiveness due to decomposition of the additives is minimized in the direct spinning machines operated with a long residence time and/or at high temperature.

The stretching is carried out in a manner known per se in at least one stage between godet-roll systems heated at different temperatures, preferably in two stages. The spun filament is preferably stretched using a stretching ratio DR, for which the following applies, as a function of the take-off speed v in m/min and the concentration c of the additive copolymer in % by weight:

$$f_3 \leqq DR \leqq f_4 \quad (4)$$

where $$f_3 = -5 \cdot 10^{-4} \cdot v - 1.6 \cdot 10^{-4} \cdot v \cdot c/x + 0.98 \cdot c/x + 3.55 \quad (5)$$

$$f_4 = -5 \cdot 10^{-4} \cdot v - 2.4 \cdot 10^{-4} \cdot v \cdot c/x + 1.46 \cdot c/x + 3.55 \quad (6)$$

In the case of multistage stretching. DR is the product of the individual stretching ratios. The wind-up speed is equal to the product of the spinning speed v, the stretching ratio DR and the relaxation ratio.

The HMLS filaments according to the invention have at least the same quality values as conventional yarn without a polymeric additive.

The property values indicated in the following examples and in the above text were determined as follows:

Additive fibrils: the thin microtome sections of the filaments were studied by transmission electron microscopy followed by evaluation by image analysis, with the diameter of the fibrils being determined, and the length being estimated from the particle diameter determined in samples immediately after the spinneret.

The intrinsic viscosity (I.V.) was determined on a solution of 0.5 g of polyester in 100 ml of a mixture of phenol and 1.2-dichlorobenzene (3:2 parts by weight) at 25° C.

In order to determine the melt viscosity (initial viscosity), the polymer was dried under reduced pressure to a water content of ≦1000 ppm (polyester ≦50 ppm). The granules were subsequently introduced onto the heated measurement plate of a plate-and-cone rheometer, type UM100, Physica MeBtechnik GmbH, Stuttgart/DE, with aeration with nitrogen. The measurement cone (MK210) was positioned on the measurement plate after the sample had melted, i.e. after about 30 seconds. The measurement was started after a further heating period of 60 seconds (measurement time=0 seconds). The measurement temperature was 290° C. for polyethylene terephthalate and additive polymers which are added to polyethylene terephthalate, or was the same as the melting point of the polyester in question plus 34.0° C. The defined measurement temperature corresponds to the typical processing or spinning temperature of the respective polyester. The amount of sample was selected in such a way that the rheometer gap was completely filled. The measurement was carried out in oscillation at the frequency 2.4 Hz (corresponding to a shear rate of 15 $sec^{-1}$) and a deformation amplitude of 0.3, and the value of the complex viscosity was determined as a function of the measurement time. The initial viscosity was then converted to the measurement time zero by linear regression.

For the determination of the glass transition temperature and the melting point of the polyester, the polyester sample was firstly melted at 310° C. for 1 minute and immediately quenched to room temperature. The glass transition temperature and the melting point were subsequently determined by DSC (differential scanning calorimetry) measurement at a heating rate of 10° C./min. The pretreatment and measurement were carried out with nitrogen aeration.

The birefringence of the spun filament (Δn) was determined by means of a polarizing microscope with tilt compensator and green filter (540 nm) using wedge sections. The path difference between the ordinary and extraordinary ray on the passage of linear-polarized light through the filaments was measured. The birefringence is the quotient of the path difference and the filament diameter. In the case of the spin-stretch process, the spun filament was removed after the take-off godet roll.

The strength properties of the fibres were determined on filaments to which a twist of 50 T/m had been applied, on a test length of 250 mm with a take-off speed of 200 mm/min. The force corresponding to an elongation of 5% in the stress-strain diagram, divided by the titre is referred to here as LASE-5.

The hot-air shrinkage was determined using the shrinkage tester from Testrite/USA, at 160° C., a pre-stress force of 0.05 cN/dtex and a treatment duration of 2 minutes.

The invention is explained in greater detail below with reference to examples:

COMPARATIVE EXAMPLES 1 to 3 AND EXAMPLES 4 to 8

In order to produce the HMLS yarn, a polyethylene terephthalate having an intrinsic viscosity of 0.98 dl/g was employed. The additive selected for Examples 4 to 7 was a copolymer comprising 90% by weight of methyl methacrylate and 10% by weight of styrene which had a glass transition temperature of 118.7° C. In Example 8, a copolymer comprising 78% by weight of styrene and 22% by weight of imidated maleic anhydride having a glass transition temperature of 168° C. was used as additive. The polyester chips and the additive polymer were melted in a 7E extruder from Barmag, Germany. The additive was metered into the feed part of the extruder. To this end, use was made of the KCLKQX2 metering system from the K-Tron Soda company, Germany, with gravimetric metering regulation. The polymer mixture melted and pre-mixed in the extruder was forced through static mixers at 160 bar and fed to a 40 $cm^3$ melt metering pump. In the process, the mixture was subjected to a shear rate of 23 $sec^{-1}$. The product of the shear rate and the residence time in seconds to the power 0.8 was 475. The spinning pump conveyed the melt, held at a temperature of 298° C. into the Lurgi Zimmer BN 110 spinning system with circular spinneret pack and annular spinneret (300 holes with a diameter of 0.4 mm). The melt throughput at all settings was 660 g/min. This corresponds to a titre of 1100 dtex at a wind-up speed of 6000 m/min. The spinneret pressure was 420 bar. The spun multifilament was cooled in a radial blowing system (from the outside inward), treated with spin finish by means of an oiling ring and fed to a 1st unheated pair of godet rolls. The speed of this 1st pair of godet rolls is, by agreement, equal to the spinning take-off speed. Only for sampling in order to determine the birefringence was the spun filament fed to a wind-up unit after just this 1st pair of godet rolls. In order to produce the HMLS filament, the filament was fed, after the 1st pair of godet rolls, over 3 further pairs of godet rolls, which were now heated, and finally wound up. The stretching was carried out between the 1st and 3rd pairs of godet rolls, the heat setting at the 3rd pair of godet rolls and the relaxation between the 3rd pair of godet rolls and the spooler. The three heated pairs of godet rolls had the following temperatures:

| | |
|---|---|
| Pair 2: | 85° C. |
| Pair 3: | 240° C. |
| Pair 4: | 150° C. |

The partial relaxation ratio between pair 4 and pair 3 was in all cases 0.995. The other settings are shown in the table. The process parameters for the spinning process were identical for all examples. Starting from the pre-specified spinning speed and a desired birefringence, the range to be used for the additive polymer concentration was calculated in accordance with Equation 1, with the factor x employed being, specific to the additive, equal to 1 for Examples 3 to 7 and equal to 2.8 for Example 8. The actual concentration was selected within the calculated range.

The preferred range in each case for the stretching ratio was calculated in accordance with Equation 4, and the actual stretching ratio was selected within the calculated range. It was possible to carry out the stretching of the spun filaments successfully in all examples according to the invention. Capillary breaks were only observed rarely. The individual values are shown in the following table.

The examples make it clear that the concentration of the additive polymer can be determined in accordance with Equation (1) according to the invention so that the desired birefringence can be achieved 3for a given spinning speed. In particular, the selection in accordance with the invention of the additive concentration means that the maximum value of the desired birefringence is not exceeded. This enables relatively high spinning speeds to be set without this resulting in a reduction in strength or an excessively large number of fibre defects, as is the case, in a disadvantageous manner, in the known processes.

In all examples according to the invention, the mean diameter of the fibrils in the filaments was less than 80 nm.

TABLE

| Example No. | | 1 Comparison | 2 Comparison | 3 Comparison | 4 Invention | 5 Invention | 6 Invention | 7 Invention | 8 Invention |
|---|---|---|---|---|---|---|---|---|---|
| Spinning take-off speed | m/min | 2500 | 3000 | 3250 | 3200 | 3300 | 3400 | 3700 | 3400 |
| Birefringence without additive | $\cdot 10^3$ | | | | 61.3 | 68.1 | 75.5 | 100.7 | 75.5 |
| Desired birefringence | $\cdot 10^3$ | | | | 45 | 52 | 50 | 51 | 50 |
| Factor X | | | | | 1 | 1 | 1 | 1 | 2.8 |
| Additive concentration calculated | % | — | — | — | 0.43–0.53 | 0.41–0.50 | 0.61–0.75 | 1.04–1.28 | 1.71–2.09 |
| Additive concentration used | % | 0 | 0 | 0 | 0.48 | 0.45 | 0.68 | 1.16 | 1.9 |
| Birefringence measured | $\cdot 10^3$ | 30.2 | 45.5 | 66.2 | 44 | 51 | 50 | 51 | 51 |
| Overall stretching, calculated | 1: | | | | 2.17–2.28 | 2.10–2.20 | 2.15–2.29 | 2.15–2.36 | 2.15–2.29 |
| Overall stretching, selected | 1: | 2.34 | 2.12 | 1.9 | 2.25 | 2.12 | 2.15 | 2.2 | 2.18 |
| 1st stretching | 1: | 1.56 | 1.41 | 1.27 | 1.50 | 1.41 | 1.43 | 1.47 | 1.45 |
| Overall relaxation ratio | 1: | 0.972 | 0.970 | 0.985 | 0.980 | 0.978 | 0.979 | 0.979 | 0.979 |
| Wind-up speed | m/min | 5690 | 6170 | 6080 | 7060 | 6840 | 7160 | 7970 | 7260 |
| Viscosity ratio | | | | | 3 | 3 | 3 | 3 | 3 |
| Yarn viscosity | dl/g | 0.89 | 0.89 | 0.89 | 0.89 | 0.89 | 0.89 | 0.89 | 0.89 |
| Tear strength | cN/tex | 70.7 | 69.1 | 65 | 72.8 | 71.7 | 70.8 | 70.7 | 71.1 |
| Elongation at break | % | 14 | 14.3 | 15.3 | 13.1 | 13.9 | 14.2 | 14.1 | 14.1 |
| LASE 5 | cN/tex | 32.6 | 35 | 35.1 | 37.7 | 35.7 | 36.8 | 36.2 | 35.8 |
| Shrinkage (160° C.) | % | 2.6 | 2.5 | 2.1 | 2.5 | 2.4 | 2.6 | 2.6 | 2.5 |
| Lints | n/10 km | 1.5 | 5 | 16 | 4 | 5.1 | 2 | 6 | 3 |

What is claimed is:

1. HMLS polyester filaments having a tear strength of >70 cN/tex, an LASE 5 of >35 cN/tex and a hot-air shrinkage at 160° C. of 1.5–3.5%, consisting of α) a polyester comprising at least 85 mol % of poly($C_{2-4}$-alkylene) terephthalate, β) from 0.1 to 2.5% by weight of an incompatible, thermoplastic, amorphous, polymeric additive having a glass transition temperature in the range from 90 to 170° C., and γ) from 0 to 5.0% by weight of further additives, where the sum of α), βand γ) is equal to 100%, the ratio of the melt viscosity of the polymeric additive β) to the melt viscosity of the polyester α) is from 1:1 to 7:1, and the polymeric additive β) is present in the HMLS filaments in the form of fibrils having a mean diameter of ≦80 nm which are distributed in the polyester α).

2. HMLS filaments according to claim 1, wherein the ratio of the melt viscosities is from 1.5:1 to 5:1.

3. HMLS filaments according to claim 1 wherein the polymeric additive β) is a polymer which comprises the following monomer units:

A=acrylic acid, methacrylic acid or $CH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-alkly radical, B=styrene or $C_{1-3}$-alkyl-substituted styrenes, where the polymer consists of from 60 to 100% by weight of A and from 0 to 40% by weight of B.

4. HMLS filaments according to claim 3, wherein the polymer consists of from 83 to 98% by weight of A and from 2 to 17% by weight of B.

5. HMLS filaments according to claim 4, wherein the polymer consists of from 90 to 98% by weight of A and from 2 to 10% by weight of B.

6. HMLS filaments according to claim 1 wherein the polymeric additive β) is a polymer which comprises the following monomer units:

C=styrene or $C_{1-3}$-alkyl-substituted styrenes,

D=one or more monomers of the formula I, II or III (I)

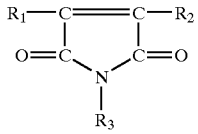

(II)

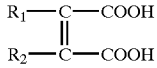

(III)

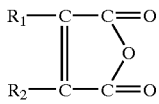

where $R_1$, $R_2$ and $R_3$ are each an H atom or a $C_{1-15}$-alkyl radical or a $C_{5-12}$-cycloalkyl radical or a $C_{6-14}$-aryl radical, and where the polymer consists of from 15 to 100% by weight of C and from 0 to 85% by weight of D, where the sum of C and D together gives 100%.

7. HMLS filaments according to claim 6, wherein the polymer consists of from 50 to 95% by weight of C and from 5 to 50% by weight of D, where the sum of C and D together gives 100%.

8. HMLS filaments according to claim 7 wherein, the polymer consists of from 70 to 85% by weight of C and from 15 to 30% by weight of D, where the sum of C and D together gives 100%.

9. HMLS filaments according to claim 1 wherein the polymeric additive β) is a polymer which comprises the following monomer units:

E=acrylic acid, methacrylic acid or $CH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-aryl radical, F=styrene or $C_{1-3}$-alkyl-substituted styrenes, G=one or more monomers of the formula I, II or III (I)

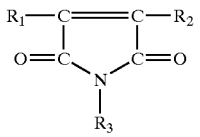

(II)

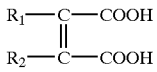

(III)

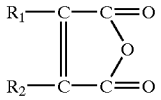

where $R_1$, $R_2$ and $R_3$ are each an H atom or a $C_{1-15}$-alkyl radical or a $C_{5-12}$-cycloalkyl radical or a $C_{6-14}$-aryl radical, H=one or more ethylenically unsaturated monomers which can be copolymerized with E and/or with F and/or G, from the group consisting of α-methylstyrene, vinyl acetate, acrylates and methacrylates which are different from E, vinyl chloride, vinylidene chloride, halogen-substituted styrenes, vinyl esters, isopropenyl ethers and dienes, where the copolymer consists of from 30 to 99% by weight of E, from 0 to 50% by weight of F, from >0 to 50% by weight of G and from 0 to 50% by weight of H, where the sum of E, F, G and H together gives 100%.

10. HMLS filaments according to claim 9, wherein the polymer consists of from 45 to 97% by weight of E, from 0 to 30% by weight of F, from 3 to 40% by weight of G and from 0 to 30% by weight of H, where the sum of E, F, G and H together gives 100%.

11. HMLS filaments according to claim 10, wherein the polymer consists of from 60 to 94% by weight of E, from 0 to 20% by weight of F, from 6 to 30% by weight of G and from 0 to 20% by weight of H, where the sum of E, F, G and H together gives 100%.

12. Spin-stretch process for the production of the HMLS filaments according to claim 1, wherein a) a polyester α) which comprises at least 85 mol % of poly($C_{2-4}$-alkylene) terephthalate and an incompatible, thermoplastic, amorphous, polymeric additive β) which has a glass transition temperature in the range from 90 to 170° C., where the ratio of the melt viscosity of the polymeric additive β) to the melt viscosity of the polyester component α) is from 1:1 to 7:1, where these may comprise from 0 to 5.0% by weight of further additives γ), are mixed in the molten state in a static mixer with shearing, where the shear rate is from 16 to 128 $sec^{-1}$, and the product of the shear rate and the residence time in the mixer in seconds to the power 0.8 is at least 250;

b) the melt mixture from step a) is spun to give spun filaments, where the spinning take-off speed is from 2500 to 4000 m/min; and c) the spun filaments from step b) are treated, stretched, heat-set and wound up, where the concentration c of the polymeric additive β) in % by weight in the polyester is determined as a function of the pre-specified take-off speed v in m/min and the desired birefringence Δn of the spun filaments in accordance with the following formulae:

$$x \cdot f_1 \leqq c \leqq x \cdot f_2 \quad (1)$$

where $$f_1 = \frac{100 \cdot (\Delta n_o - \Delta n)}{\Delta n_o (7.2589 \cdot 10^{-6} \cdot v^2 - 7.7932 \cdot 10^{-2} \cdot v + 236.0755)} \quad (2)$$

$$f_2 = \frac{100 \cdot (\Delta n_o - \Delta n)}{\Delta n_o (5.9391 \cdot 10^{-6} \cdot v^2 - 6.3763 \cdot 10^{-2} \cdot v + 193.1527)} \quad (3)$$

where $\Delta n < \Delta n_o$

Δn=birefringence of the polyester spun filament according to the invention with additive, $\Delta n_o$=birefringence of polyester spun filament produced under identical spinning conditions, as in accordance with the invention, without additive, x=1 for additive polymers of type 1 or 3, and x=2.8 for additive polymers of type 2 (without acrylic compound).

13. Spin-stretch process according to claim 12, wherein, in stage c), the stretching ratio DR is determined in accordance with the following formulae as a function of the spinning speed v in m/min and the concentration c of the additive in % by weight:

$$f_3 \leqq DR \leqq f_4 \quad (4)$$

where $$f_3 = -5 \cdot 10^{-4} \cdot v - 1.6 \cdot 10^{-4} \cdot v \cdot c/x + 0.98 \cdot c/x + 3.55 \quad (5)$$

$$f_4 = -5 \cdot 10^{-4} \cdot v - 2.4 \cdot 10^{-4} \cdot v \cdot c/x + 1.46 \cdot c/x + 3.55 \quad (6).$$

14. Spin-stretch process according to claim 13, wherein, in stage c), the wind-up speed is equal to the product of the spinning speed v, the stretching ratio DR and the relaxation ratio.

* * * * *

UNITED STATES PATENT AND TRADEMARK OFFICE

CERTIFICATE OF CORRECTION

PATENT NO. : 6,740,404 B1
APPLICATION NO. : 10/049009
DATED : May 25, 2004
INVENTOR(S) : Cziollek et al.

It is certified that error appears in the above-identified patent and that said Letters Patent is hereby corrected as shown below:

Column 1, Line 30, "In EP 0 423 213 B." should read -- In EP 0 423 213 B,--

Column 5, Line 30, "filament An in" should read -- filament $\Delta$n in--

Signed and Sealed this

Eighth Day of August, 2006

JON W. DUDAS
*Director of the United States Patent and Trademark Office*